US009030397B2

(12) United States Patent
Wang

(10) Patent No.: US 9,030,397 B2
(45) Date of Patent: May 12, 2015

(54) GATE DRIVER, DRIVING CIRCUIT, AND LCD

(75) Inventor: Jieqiong Wang, Beijing (CN)

(73) Assignee: Beijing BOE Optoelectronics Technology Co., Ltd., Beijing (CN)

( * ) Notice: Subject to any disclaimer, the term of this patent is extended or adjusted under 35 U.S.C. 154(b) by 335 days.

(21) Appl. No.: 13/329,534

(22) Filed: Dec. 19, 2011

(65) Prior Publication Data

US 2012/0162054 A1 Jun. 28, 2012

(30) Foreign Application Priority Data

Dec. 23, 2010 (CN) ..... 2010 2 0677703 U

(51) Int. Cl.
*G09G 3/36* (2006.01)

(52) U.S. Cl.
CPC ..... *G09G 3/3674* (2013.01); *G09G 2310/0267* (2013.01); *G09G 3/3677* (2013.01)

(58) Field of Classification Search
CPC . G09G 3/3674; G09G 3/3677; G09G 3/3681; G09G 2310/0202; G09G 2310/0216; G09G 2310/0264; G09G 2310/0267
USPC ..... 345/92, 204, 208, 112, 99, 100; 327/108; 362/82
See application file for complete search history.

(56) References Cited

U.S. PATENT DOCUMENTS 4,074,256 A 2/1978 Sekiya et al.
5,859,635 A * 1/1999 Hang et al. ..... 345/213
7,176,874 B2 * 2/2007 Furukoshi ..... 345/99
7,466,312 B2 * 12/2008 Choi et al. ..... 345/211
7,522,160 B2 * 4/2009 Moon ..... 345/204
7,605,793 B2 * 10/2009 Lee ..... 345/100
8,085,261 B2 * 12/2011 Fang et al. ..... 345/212
8,089,446 B2 * 1/2012 Pak et al. ..... 345/100
8,232,941 B2 * 7/2012 Yeo et al. ..... 345/87
8,441,427 B2 * 5/2013 Wang ..... 345/99
2004/0125061 A1 * 7/2004 Furukoshi ..... 345/87
2005/0035958 A1 * 2/2005 Moon ..... 345/204

(Continued)

FOREIGN PATENT DOCUMENTS

CN 1581256 A 2/2005
CN 101136160 A 3/2008

(Continued)

OTHER PUBLICATIONS

USPTO NFOA Dated May 22, 2014; U.S. Appl. No. 12/881,391.

(Continued)

*Primary Examiner* — Lun-Yi Lao
*Assistant Examiner* — Peter D McLoone
(74) *Attorney, Agent, or Firm* — Ladas & Parry LLP

(57) ABSTRACT

There is disclosed a gate driver, a driving circuit, and a liquid crystal display (LCD), wherein the gate driver comprises input terminals for inputting a CPV signal, an OE signal, and an STV signal, and output terminals for outputting a CKV signal and a CKVB signal, and a processing circuit is connected between the input terminals and the output terminals for processing the CPV signal, the OE signal, and the STV signal such that a preset time interval is present between the falling edge of the CKV signal and the rising edge of the CKVB signal during one period of the CKV signal, or a preset time interval is present between the rising edge of the CKV signal and the falling edge of the CKVB signal during one period of the CKVB signal.

6 Claims, 2 Drawing Sheets

(56) References Cited

U.S. PATENT DOCUMENTS

| | | | | |
|---|---|---|---|---|
| 2005/0104647 | A1* | 5/2005 | Choi et al. | 327/333 |
| 2006/0103619 | A1 | 5/2006 | Kim | |
| 2006/0290637 | A1 | 12/2006 | Kang et al. | |
| 2007/0139339 | A1 | 6/2007 | Kim et al. | |
| 2008/0036717 | A1* | 2/2008 | Moon | 345/87 |
| 2008/0055225 | A1* | 3/2008 | Pak et al. | 345/96 |
| 2008/0055282 | A1* | 3/2008 | Lee | 345/204 |
| 2008/0080661 | A1 | 4/2008 | Tobita | |
| 2008/0084378 | A1* | 4/2008 | Lee et al. | 345/92 |
| 2008/0117157 | A1 | 5/2008 | Hwang et al. | |
| 2008/0136756 | A1* | 6/2008 | Yeo et al. | 345/87 |
| 2008/0165169 | A1 | 7/2008 | Lee | |
| 2008/0192032 | A1* | 8/2008 | Park et al. | 345/204 |
| 2008/0218502 | A1 | 9/2008 | Lee et al. | |
| 2009/0009497 | A1* | 1/2009 | Lee et al. | 345/205 |
| 2009/0021502 | A1* | 1/2009 | Lee et al. | 345/205 |
| 2010/0182305 | A1* | 7/2010 | Fang et al. | 345/212 |
| 2010/0303195 | A1* | 12/2010 | Wang | 377/64 |
| 2011/0063278 | A1* | 3/2011 | Han | 345/212 |
| 2012/0162054 | A1 | 6/2012 | Wang | |

FOREIGN PATENT DOCUMENTS

| | | | |
|---|---|---|---|
| CN | 101187743 | A | 5/2008 |
| CN | 101221818 | A | 7/2008 |
| CN | 101261412 | A | 9/2008 |
| CN | 101303838 | A | 11/2008 |

OTHER PUBLICATIONS

USPTO FOA Dated Oct. 22, 2014; U.S. Appl. No. 12/881,391.

* cited by examiner

GATE DRIVER, DRIVING CIRCUIT, AND LCD

BACKGROUND

The present disclosure relates to a gate driver, a driving circuit for, and a liquid crystal display (LCD).

A LCD is a flat plate display commonly used currently, and a thin film transistor liquid crystal display (TFT-LCD) is the mainstream product of the LCD. FIG. 1 is a schematic structural diagram showing a driving circuit for a TFT-LCD in the prior art, in which a timing controller 1 is used to generate various controlling signals, such as a gate line turning-on signal which is usually referred to as the Clock Pulse Vertical (CPV) signal in the art, a gate frame turning-on signal which is usually referred to as the Start Vertical (STV) signal in the art, a gate output enabling signal which is usually referred to as the Output Enable (OE) signal, etc. The timing controller 1 inputs the various controlling signals generated into a high voltage TFT-LCD logic driver 2, which generates a first clock signal which is usually referred to as the CKV signal in the art, a second clock signal which is usually referred to as the CKVB signal in the art, and an improved STV signal which is usually referred to as the STVP signal by the SPV signal, the SW signal and the OE signal etc. The improved STV signal refers to an SW signal for which the level has been adjusted. Since the level of the STV signal output from the timing controller may not coincide with the level of the STV signal required by the gate driving circuit, it is required to convert the level of the STV signal by some level converting circuits. It is possible to drive the gate by inputting the CKVB signal, the CKV signal, and the STVP signal into a gate driving circuit 3.

In a driving circuit for a TFT-LCD, when the gate driving circuit outputs a gate driving signal, which is usually referred to as the Gate signal, to turn on a row of gate lines, usually a source driving circuit inputs the data signals of the respective pixels corresponding to the row of gate lines onto the respective pixel electrodes of the row. In other words, when the Gate signal is of a high level, the source driving circuit inputs the data signals into the pixel electrodes. In a practical application, the falling edge of the Gate signal delays, therefore, when the Gate1 signal of the current row is in its falling edge, the Gate2 signal of the next row has already started to rise. In other words, the source driving circuit inputs the data corresponding to the next row of pixels before the respective TFTs corresponding to the previous row of gate lines are turned off, which results in a mix with the data of the previous row of pixels and influences the quality of the image display.

SUMMARY

The present disclosure provides a gate driver, a driving circuit, and a liquid crystal display (LCD) for avoiding the mix of the data input into the pixel electrodes due to the delay of the gate driving signal.

An embodiment of the disclosure provides a gate driver, comprising input terminals for inputting a CPV signal, an OE signal, and an STV signal, and output terminals for outputting a CKV signal and a CKVB signal, wherein a processing circuit is connected between the input terminals and the output terminals for processing the CPV signal, the OE signal, and the STV signal such that a preset time interval is present between the falling edge of the CKV signal and the rising edge of the CKVB signal during one period of the CKV signal, or a preset time interval is present between the rising edge of the CKV signal and the falling edge of the CKVB signal during one period of the CKVB signal.

In an example, the processing circuit comprises a NOT gate L1, a D flip-flop D1, a first AND gate L2, a second AND gate L3, a first logic combination circuit C1, a first logic selection circuit L4, and a second logic selection circuit L5, wherein the input terminal of the NOT gate L1 is connected to the input terminal of the OE signal; the output terminal of the NOT gate L1 is connected to both the input terminal of the first AND gate L2 and the input terminal of the second AND gate L3; the triggering terminal CKV of the D flip-flop D1 is connected to the CPV signal input terminal; the input terminal D of the D flip-flop D1 is connected to the inverse output terminal $\overline{Q}$; the inverse output terminal $\overline{Q}$ of the D flip-flop D1 is connected to the input terminal of the second AND gate L3; the output terminal Q of the D flip-flop D1 is connected to the input terminal of the AND gate L2; the reset terminal RST of the D flip-flop D1 is connected to the STV signal input terminal; the input terminals of the first logic combination circuit C1 are connected to the CPV signal input terminal, the output terminal of the first AND gate L2, and the output terminal of the second AND gate L3, respectively; the output terminals of the first logic combination circuit C1 are connected to the first logic selection circuit L4 and the second logic selection circuit L5, respectively; the output terminal of the first logic selection circuit L4 is connected to the CKV signal output terminal; the output terminal of the second logic selection circuit L5 is connected to the CKVB signal output terminal; the first logic selection circuit L4 and the second logic selection circuit L5 are connected to a high selective reference voltage VON and a low selective reference voltage VOFF, respectively.

In an example, the output terminals are also used to output an STVP signal.

In an example, the time interval is a time when the OE signal remains high voltage.

Another embodiment of the present disclosure provides a driving circuit, comprising a source driver and a gate driver, wherein, the gate driver adopts the gate driver described above.

Still another embodiment of the present disclosure provides a TFT-LCD, comprising a frame, a liquid crystal display panel, and a driving circuit, wherein the driving circuit adopts the driving circuit.

According to the gate driver, the driving circuit, and the TFT-LCD provided according to embodiments of the present disclosure, by converting the STV signal, the OE signal, and the CPV signal in the prior art into the CKV signal and the CKVB signal through the processing circuit, the falling edge of the CKV signal can be displaced from the rising edge of the CKVB signal by a certain time during one period of the CKV signal, or the falling edge of the CKVB signal can be displaced from the rising edge of the CKV by a certain time during one period of the CKVB signal, such that the mix of the data input into the pixel electrodes due to the delay of the gate driving signal is avoided.

Further scope of applicability of the present disclosed technology will become apparent from the detailed description given hereinafter. However, it should be understood that the detailed description and specific examples, while indicating preferred embodiments of the disclosed technology, are given by way of illustration only, since various changes and modifications within the spirit and scope of the disclosed technology will become apparent to those skilled in the art from the following detailed description.

BRIEF DESCRIPTION OF THE DRAWINGS

The present disclosed technology will become more fully understood from the detailed description given hereinafter and the accompanying drawings which are given by way of illustration only, and thus are not limitative of the present disclosed technology and wherein.

DETAILED DESCRIPTION

In order to make the objects, technical solutions, and advantages of the embodiments of the present disclosure more clear, a description will be made to the technical solutions of the embodiments of the present disclosure clearly and completely, in conjunction with the drawings accompanying the embodiments. Obviously, the described embodiments are only part of, but not all, the embodiments of the disclosed technology. All other embodiments obtained by those skilled in the art based on the embodiments in the present disclosure without any creative work fall within the scope of the disclosed technology.

Figure 1:
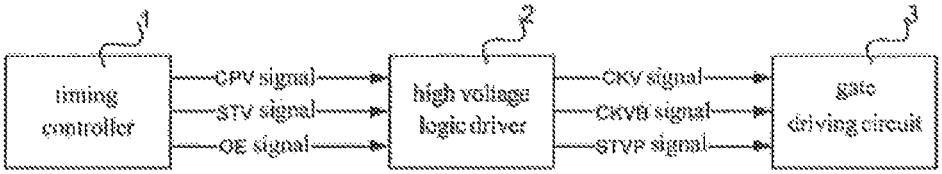
FIG. 1 (PRIOR ART)
FIG. 1 is a schematic structural diagram of a driving circuit for a TFT-LCD in the prior art.
Figure 2:
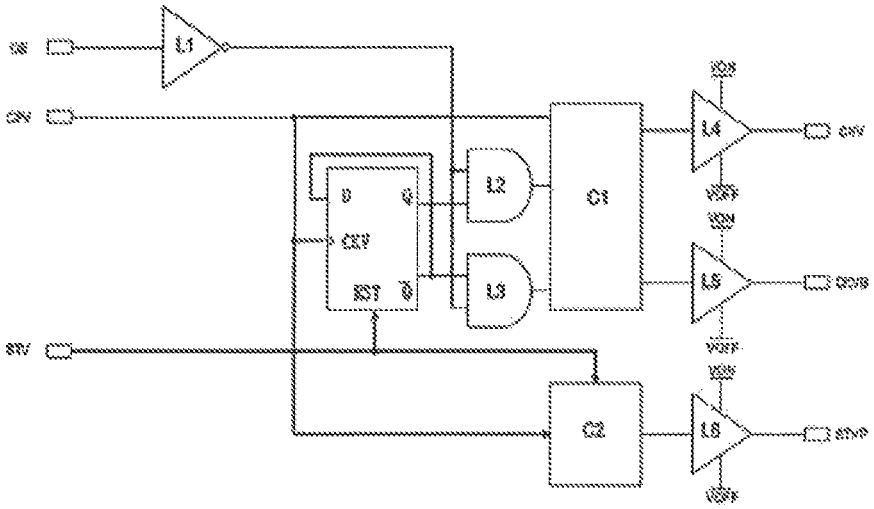
FIG. 2 is a schematic structural diagram of a gate driver for a TFT-LCD according to a first embodiment of the present disclosure.

FIG. 2 is a schematic structural diagram of a gate driver for a TFT-LCD according to a first embodiment of the present disclosure. As shown in FIG. 2, the gate driver for the TFT-LCD according to the present disclosure may comprise input terminals for inputting a CPV signal, an OE signal, and an STV signal, and output terminals for outputting a CKV signal and a CKVB signal. A processing circuit is connected between the input terminals and the output terminals for processing the CPV signal, the OE signal, and the STV signal such that a preset time interval is present between the falling edge of the CKV signal and the rising edge of the CKVB signal during one period of the CKV signal, or a preset time interval is present between the rising edge of the CKV signal and the falling edge of the CKVB signal during one period of the CKVB signal.

The input terminals may comprise a CPV signal input terminal for inputting the CPV signal, an OE signal input terminal for inputting the OE signal, and an STV signal input terminal for inputting the STV signal. The output terminals may comprise a CKV signal output terminal for outputting the CKV signal and a CKVB signal output terminal for outputting the CKVB signal.

Specifically, the input terminals INPUT may comprise the CPV signal input terminal, the OE signal input terminal, and the STV signal input terminal. The output terminals OUTPUT may comprise the CKV signal output terminal and the CKVB signal output terminal. In an example, the processing circuit may comprise a NOT gate L1, a D flip-flop D1, a first AND gate L2, a second AND gate L3, a first logic combination circuit C1, a first logic selection circuit L4, and a second logic selection circuit L5, wherein, the input terminal of the NOT gate L1 is connected to the input terminal of the OE signal;

the output terminal of the NOT gate L1 is connected to both the input terminal of the first AND gate L2 and the input terminal of the second AND gate L3;

the triggering terminal CKV of the D flip-flop D1 is connected to the CPV signal input terminal;

the input terminal D of the D flip-flop D1 is connected to the inverse output terminal $\overline{Q}$;

the inverse output terminal $\overline{Q}$ of the D flip-flop D1 is connected to the input terminal of the second AND gate L3;

the output terminal Q of the D flip-flop D1 is connected to the input terminal of the AND gate L2;

the reset terminal RST of the D flip-flop D1 is connected to the STV signal input terminal;

the input terminals of the first logic combination circuit C1 are connected to the CPV signal input terminal, the output terminal of the first AND gate L2, and the output terminal of the second AND gate L3, respectively;

the output terminals of the first logic combination circuit C1 are connected to the first logic selection circuit L4 and the second logic selection circuit L5, respectively;

the output terminal of the first logic selection circuit L4 is connected to the CKV signal output terminal;

the output terminal of the second logic selection circuit L5 is connected to the CKVB signal output terminal;

the first logic selection circuit L4 and the second logic selection circuit L5 are connected to a high selective reference voltage VON and a low selective reference voltage VOFF, respectively.

In FIG. 2, the input terminal D, the output terminal Q, the inverse output terminal $\overline{Q}$, and the reset terminal RST of the D flip-flop D1 are well known in the field of the electronic circuit, and will not be discussed here in detail.

The operating principle of the gate driver for the TFT-LCD according to the embodiments of the present disclosure is described below. In FIG. 2, when the CPV signal rises to a high level, because the input terminal D of the D flip-flop D1 is connected to the inverse output $\overline{Q}$, the CPV signal inverts the output of the D flip-flop D1 as an edge-triggering signal, which then inverts the output of the first logic combination circuit C1, switches the level of the first logic selection circuit L4 and the second logic selection circuit L5, and further inverts the phases of the CKV signal and the CKVB signal, resulting in a line switching of the Gate signal inputted into the gates. The OE signal is introduced into the circuit by the first logic AND gate L2 and the second AND gate L3. When the OE signal rises to the high level, the signal becomes low after passing through the NOT gate L1, and the output signals of both the first AND gate L2 and the second AND gate L3 are in a low level. The signals from the first AND gate L2 and the second AND gate L3, after passing though the first logic combination circuit C1, make the output signals of both the first logic selection circuit L4 and the second logic selection circuit L5 connect to the low voltage VOFF, that is, the CKV signal and the CKVB signal both output the low voltage VOFF. Therefore, a preset time interval is present between the falling edge of the CKV signal and the rising edge of the CKVB signal during one period of the CKV signal, or a preset time interval is present between the rising edge of the CKV signal and the falling edge of the CKVB signal during one period of the CKVB signal, resulting in that the gates are turned off at an expected time.

Figure 3:
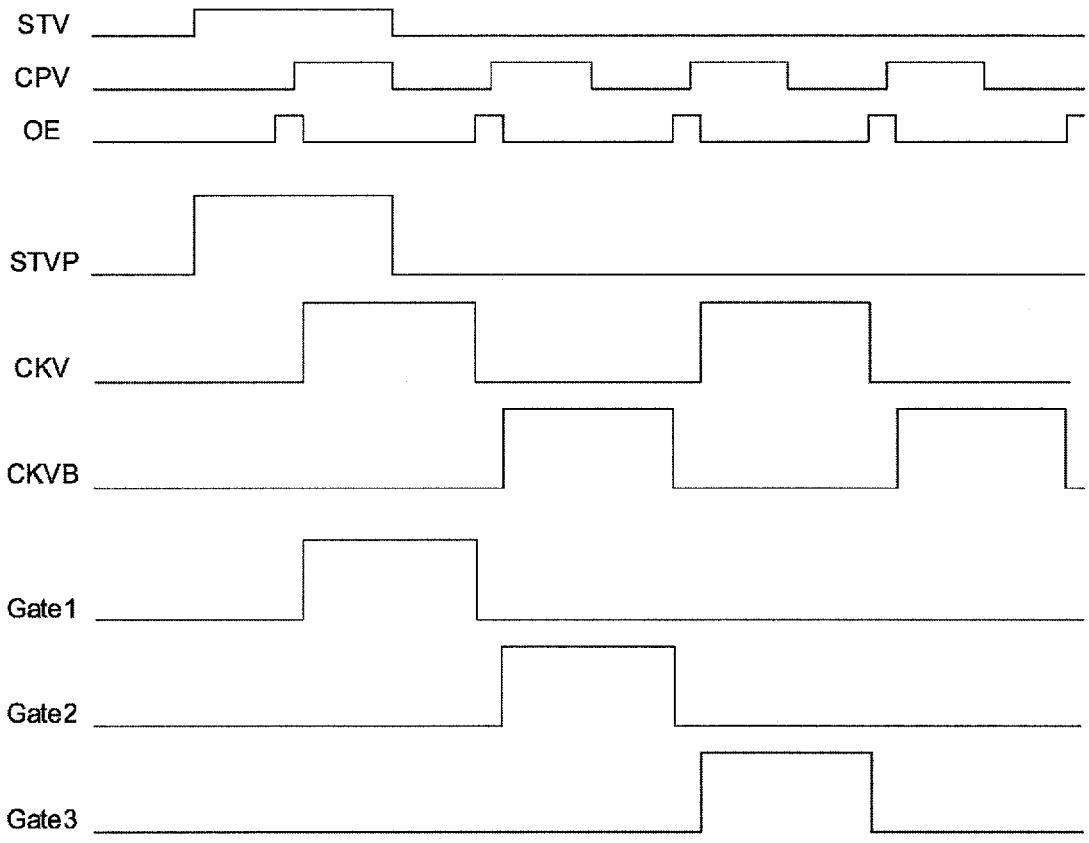
FIG. 3 is a timing diagram of the gate driver for the TFT-LCD according the first embodiment of the present disclosure.

FIG. 3 is a timing diagram for the gate driver for the TFT-LCD according the first embodiment of the present disclosure. As shown in FIG. 3, the STV signal, the OE signal, and the CPV signal are input signals, and the CKV signal and the CKVB signal are output signals. Conventionally, a Gate signal is output at both the rising edge of the CKV signal and the rising edge of the CKVB signal. The period of the CKV signal is the same as that of the CKVB signal, and their rising edges arise alternately, so as to output the gate driving signals for respective rows of gate lines in turn. As seen from FIG. 3, the falling edge of the OE signal corresponds to the rising edge of the CKV signal or the CKVB signal. However, during one period of the CKV signal, a time interval which is the high voltage maintaining time within one period of the OE signal exists between the falling edge of the CKV signal and the rising edge of the CKVB signal, and during one period of the CKVB signal, the time interval which is the high voltage maintaining time within one period of the OE signal also exists between the falling edge of the CKVB signal and the rising edge of the CKV signal. Therefore, even though the delay of the falling edge of the CKV signal and the falling edge of the CKVB signal causes the delay of the falling edge of the Gate signal, the data will not be mixed, and the quality of the image displaying is ensured.

Further, the output terminals according to the embodiment can also be used to output the STVP signal, i.e. comprise an STVP signal output terminal. Accordingly, in another example, the processing circuit can further comprise a second logic combination circuit C2 and a second logic selection circuit L6, wherein, the input terminals of the second logic combination circuit C2 are connected to the CPV signal input terminal and the STV signal input terminal, respectively;

the output terminal of the second logic combination circuit C2 is connected to the input terminal of a third logic selection circuit L6;

the output terminal of the third logic selection circuit L6 is connected to the STVP signal output terminal;

the third logic selection circuit L6 is connected to the high selective reference voltage VON and the low selective reference voltage VOFF. In particular, the STV signal is level-converted to generate the STVP signal by the third logic selection circuit L6, in order to charge the first row of gate lines.

In the embodiment, by generating the CKV signal and the CKVB signal with the STV signal, the OE signal, and the CPV signal in the prior art through the processing circuit, the falling edge of the CKV signal is displaced from the rising edge of the CKVB by a certain time during one period of the CKV signal, or the falling edge of the CKVB signal is displaced from the rising edge of the CKV signal by a certain time during one period of the CKVB signal, such that the mix of the data input into the pixel electrodes due to the delay of the gate driving signal is avoided.

The present disclosure also provides a driving circuit for a TFT-LCD, which comprises a source driver and a gate driver. The gate driver adopts the gate driver for the TFT-LCD according to the above-described embodiment.

Finally, it should be noted that the above-mentioned embodiments are only for illustrating the technical solutions of the present disclosure, but not intended to limit the disclosure. Although the disclosure has been described in detail with reference to the above-mentioned embodiments, those skilled in the art should understand that the technical solutions described in the above-mentioned embodiments can be modified, or a part of their technical features can be replaced by equivalents thereof, and the modifications and replacements do not depart from the spirit and scope of the technical solution of each embodiment of the disclosure.

What is claimed is:

1. A gate driver, comprising:

input terminals for inputting a CPV signal, an OE signal and an STV signal, and output terminals for outputting a CKV signal and a CKVB signal, wherein a processing circuit is connected between the input terminals and the output terminals for processing the CPV signal, the OE signal, and the STV signal such that a preset time interval greater than zero is present between the fallings edge of the CKV signal and the rising edge of the CKVB signal during one period of the CKV signal, or a preset time interval greater than zero is psesent between the rising edge of the CKV signal and the falling edge of the CKVB signal during one period of the CKVB signal, wherein the processing circuit comprises a NOT gate L1, a D flip-flop D1, a first AND gate L2, a second AND gate L3, a first logic combination circuit C1, a first logic selection circuit L4, and a second logic selection circuit L5, wherein, the input terminal of the NOT gate L1 is directly connected to the input terminal of the OE signal;

the output terminal of the NOT gate L1 is directly connected to the input terminal of the first AND gate L2 and the input terminal of the second AND gate L3, respectively;

the triggering terminal CKV of the D flip-fop D1 is directly connected to the CPV signal input terminal;

the input terminal D of the D flip-flop D1 is connected to an inverse output terminal $\overline{Q}$;

the inverse output terminal $\overline{Q}$of the D flip-flop D1 is connected to the input terminal of the second AND gate L3;

the output terminal Q of the D flip-flop D1 is connected to the input terminal of the AND gate L2;

the reset terminal RST of the D flip-flop D1 is connected to the STV signal input terminal;

the input terminals of the first logic combination circuit C1 are connected to the CPV signal input terminal, the output terminal of the first AND gate L2, and the output terminal of the second AND gate L3, respectively;

the output terminals of the first logic combination circuit C1 are connected to the first logic selection circuit L4 and the second logic selection circuit L5, respectively;

the output terminal of the first logic selection circuit L4 is connected to the CKV signal output terminal;

the output terminal of the second logic selection circuit L5 is connected to the CKVB signal output terminal; and the first logic selection circuit L4 and the second logic selection circuit L5 are connected to a high selective reference voltage VON and a low selective reference voltage VOFF, respectively.

2. The gate driver according to claim 1, wherein the output terminals are also used to output an STVP signal; and the processing circuit further comprises a second logic combination circuit C2 and a second logic selection circuit L6, wherein the input terminals of the second logic combination circuit C2 are connected to the CPV signal input terminal and the STV signal input terminal, respectively;

the output terminal of the second logic combination circuit C2 is connected to the input terminal of a third logic selection circuit L6;

the output terminal of the third logic selection circuit L6 is connected to the STVP signal output terminal; and the third logic selection circuit L6 is connected to the high selective reference voltage VON and the low selective reference voltage VOFF.

3. The gate driver according to claim 1, wherein the time interval present between the falling edge of the CKV signal and the rising edge of the CKVB signal during one period of the CKV signal or the time interval present between the rising edge of the CKV signal and the falling edge of the CKVB signal during one period of the CKVB signal is the time when the OE signal remains a high voltage.

4. The gate driver according to claim 1, wherein the time interval present between the falling edge of the CKV signal and the rising edge of the CKVB signal during one period of the CKV signal or the time interval present between the rising edge of the CKV signal and the falling edge of the CKVB signal during one period of the CKVB signal is the time when the OE signal remains a high voltage.

5. A thin film transistor liquid crystal display (TFT-LCD), comprising a frame, a liquid crystal display panel, and a driving circuit, wherein the driving circuit adopts the driving circuit according to claim 4.

6. A driving circuit, comprising a source driver and a gate driver, wherein, the gate driver adopts the gate driver according to claim 1.

* * * * *